US007202835B2

(12) United States Patent
Chiang et al.

(10) Patent No.: US 7,202,835 B2
(45) **Date of Patent: *Apr. 10, 2007**

(54) DUAL BAND PHASED ARRAY EMPLOYING SPATIAL SECOND HARMONICS

(75) Inventors: Bing Chiang, Melbourne, FL (US); Michael J. Lynch, Merritt Island, FL (US); Griffin K. Gothard, Satellite Beach, FL (US)

(73) Assignee: IPR Licensing, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/873,834

(22) Filed: Jun. 22, 2004

(65) Prior Publication Data

US 2005/0052332 A1 Mar. 10, 2005

Related U.S. Application Data

(63) Continuation of application No. 10/292,384, filed on Nov. 8, 2002, now Pat. No. 6,753,826.

(60) Provisional application No. 60/345,412, filed on Nov. 9, 2001.

(51) Int. Cl.
*H01Q 19/10* (2006.01)

(52) U.S. Cl. ..... 343/834; 343/833; 343/819

(58) Field of Classification Search ..... 343/834, 343/833, 815, 814, 810, 837, 819; 342/372, 342/374, 368

See application file for complete search history.

(56) References Cited

U.S. PATENT DOCUMENTS 4,290,071 A * 9/1981 Fenwick ..... 343/819
5,767,807 A 6/1998 Pritchett ..... 342/374
5,905,473 A 5/1999 Taenzer ..... 343/834
6,100,843 A 8/2000 Proctor, Jr. et al. ..... 342/368
6,369,770 B1 4/2002 Gothard et al. ..... 343/794
6,515,635 B2 2/2003 Chiang et al. ..... 343/834

(Continued)

FOREIGN PATENT DOCUMENTS

AT 392173 B 2/1991

(Continued)

OTHER PUBLICATIONS

Harrington, R.F., Reactively Controlled Directive Arrays, *IEEE Transactions on Antennas and Propagation*, vol. AP-26, No. 3, May 1978.

*Primary Examiner*—Don Wong
*Assistant Examiner*—Angela M Lie
(74) *Attorney, Agent, or Firm*—Volpe and Koenig, P.C.

(57) ABSTRACT

A directive antenna operable in multiple frequency bands includes an active antenna element and at least one passive antenna element parasitically coupled to the active antenna element. The passive antenna element(s) have length and spacing substantially optimized to operate at (i) a fundamental frequency associated with the active antenna element and (ii) a higher resonant frequency related to the fundamental frequency. Spatial-harmonic current-distributions of the passive antenna elements are used to create the multiple frequency bands of operation. The directive antenna also includes devices operatively coupled to the passive antenna element(s) to steer an antenna beam formed by applying a signal at the fundamental resonant frequency, higher resonant frequency, or both to the active antenna element to operate in the multiple frequency bands.

25 Claims, 12 Drawing Sheets

U.S. PATENT DOCUMENTS

| | | | | |
|---|---|---|---|---|
| 6,600,456 | B2 | 7/2003 | Gothard et al. | 343/834 |
| 6,894,653 | B2 * | 5/2005 | Chiang et al. | 343/757 |
| 2002/0008672 | A1 | 1/2002 | Gothard et al. | 343/893 |
| 2002/0158798 | A1 | 10/2002 | Chiang et al. | 342/372 |
| 2002/0171599 | A1 * | 11/2002 | Palmer et al. | 343/834 |

FOREIGN PATENT DOCUMENTS

| | | | |
|---|---|---|---|
| EP | 0 860 897 | A1 | 8/1998 |
| JP | 59 091707 | A | 5/1984 |

* cited by examiner

DUAL BAND PHASED ARRAY EMPLOYING SPATIAL SECOND HARMONICS

RELATED APPLICATION(S)

This application is a continuation of U.S. patent application Ser. No. 10/292,384, filed on Nov. 8, 2002, No U.S. Pat. No. 6,753,826 , which claims the benefit of U.S. Provisional Application No. 60/345,412, filed on Nov. 9, 2001. The entire teachings of the above application are incorporated herein by reference.

BACKGROUND OF THE INVENTION

As wireless networks mature and become more widely used, higher data rates are offered. An example of such a wireless network is a wireless local area network (WLAN) using an 802.11, 802.11a, or 802.11b protocol generally referred to hereinafter as the 802.11 protocol. The 802.11 protocol specifies a 2.4 GHz (802.11b) carrier frequency for the traditional service and 5.2 GHz (802.11a) and 5.7 GHz (802.11g) carrier frequencies for newer, higher data rate services.

As with other radios, a wireless network adapter includes a transmitter and receiver connected to an antenna. The antenna is designed to provide maximum gain at a given frequency. For example, if a monopole antenna were designed to operate most effectively at 2.4 GHz, it would not optimally support operation at 5 GHz. Similarly, if a directive antenna were designed to operate most effectively at 5 GHz, backward compatibility with 2.4 GHz 802.11 would be compromised.

SUMMARY OF THE INVENTION

To address the issue of having compatibility with multiple wireless network carrier frequencies, an inventive directive antenna provides high gain and directivity at multiple operating frequencies. In this way, a system employing the inventive directive antenna is compatible with multiple wireless systems, and, in the case of 802.11 WLAN systems, provides compatibility at the 2.4 GHz and 5 GHz carrier frequencies, thereby providing backward and forward compatibility.

A broad range of implementations of the directive antenna are possible, where spacing, length, antenna structure, reactive coupling to ground, and ground plane designs are example factors that are used to provide the multi-frequency support. Multiple spatial-harmonic current-distributions of passive element(s) that are parasitically coupled to at least one active antenna element are used to create multiple frequency bands of operation.

In one embodiment, the inventive directive antenna, operable in multiple frequency bands, includes an active antenna element and at least one passive antenna element parasitically coupled to the active antenna element. The passive antenna element(s) have length and spacing substantially optimized to selectively operate at (i) a fundamental frequency associated with the active antenna element or (ii) a higher resonant frequency related to the fundamental frequency. The higher resonant frequency may be a second harmonic of the fundamental frequency.

The directive antenna may also include a device(s) operatively coupled to the passive antenna element(s) to steer an antenna beam formed by applying a signal at the fundamental or higher resonant frequency to the active antenna element to operate in the multiple frequency bands.

The directive antenna may steer the antenna beams at the fundamental frequency and the higher resonant frequency simultaneously.

The directive antenna may further include reactive loading elements coupled by the switches between the passive antenna element(s) and a ground plane. The reactive loading element(s) may be operatively coupled to the passive antenna element(s) to make the associated passive antenna element(s) a reflector at the fundamental frequency. The same reactive loading may turn the associated passive antenna element into a director at the higher resonant frequency. The opposite conditions may also be achieved by the reactive loading element(s).

The antenna elements may be monopoles or dipoles. Further, the antenna elements may be two- and three-dimensional elements that support more than two resonances. The antenna elements may further have length and spacing to support more than two frequency bands. Additionally, the antenna elements may be elements that support higher resonant frequencies that are not integer multiples of the fundamental frequency.

The antenna elements may be arranged in the manner that the higher resonant frequency is a non-integer multiple of the fundamental frequency. The directive antenna may further include an input impedance coupled to the array across the desired bands and can be optimized using optimization techniques, including: addition of a folding arm of proper thickness to the active antenna elements, using lumped impedance elements, using transmission line segments, or a combination of optimization techniques.

The directive antenna may be used in cellular systems, handsets, wireless Internets, wireless local area networks (WLAN), access points, remote adapters, repeaters, and 802.11 networks.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF A PREFERRED EMBODIMENT

Figure 1:
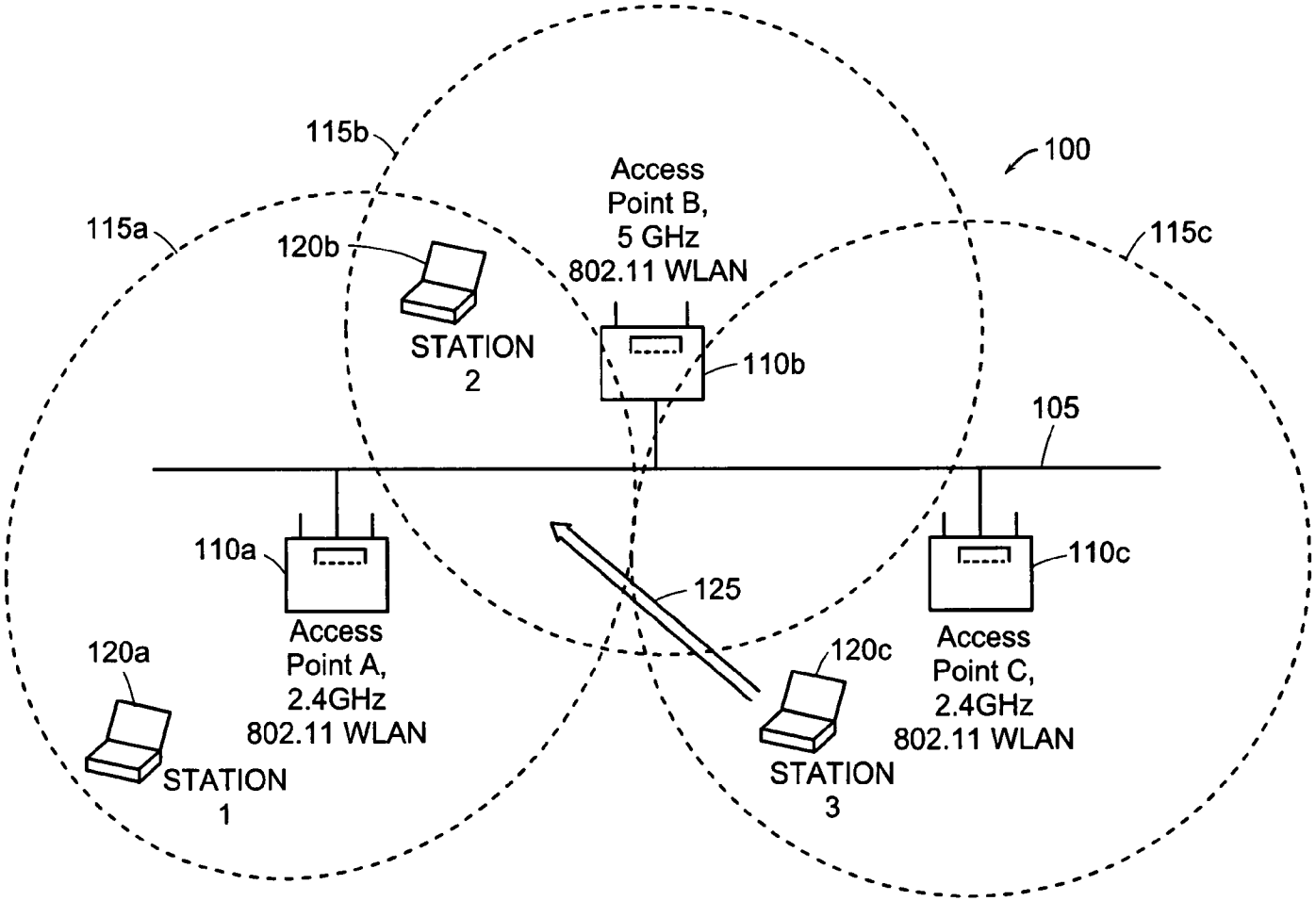
FIG. 1 is a schematic diagram of a wireless network, such as an 802.11 wireless local area network (WLAN), in which the inventive directive antenna may be employed.

A detailed description of preferred embodiments of the invention follow:

FIG. 1 is a schematic diagram of an example wireless network in which embodiments of the inventive, directive, multi-frequency band antenna may be employed. The wireless network is a wireless local area network (WLAN) 100 having a distribution system 105. Access points 110*a*, 110*b*, and 110*c* are connected to the distribution system 105 via wired connections. Each of the access points 110 has a respective zone 115*a*, 115*b*, 115*c* in which it is capable of transmitting and receiving RF signals with stations 120*a*, 120*b*, 120*c*, which are supported with wireless local area network hardware and software to access the distribution system 105.

Present technology provides the access points 110 and stations 120 with antenna diversity. The antenna diversity allows the access points 110 and stations 120 with an ability to select one of two antennas to provide transmit and receive duties based on the quality of signal being received. A reason for selecting one antenna over the other is in the event of multi-path fading in which a signal taking two different paths to the antennas causes signal cancellation to occur at one antenna but not the other. Another example is when interference is caused by two different signals received at the same antenna. Yet another reason for selecting one of the two antennas is due to a changing environment, such as when a station 120*c* is carried from the third zone 115*c* to the first and second zones 120*a*, 120*b*, respectively.

In the WLAN 100, access points A and C use traditional 2.4 GHz carrier frequency 802.11 protocols. Access point B, however, uses a newer, higher bandwidth 5 GHz carrier frequency 802.11 protocol. This means that if the station 120*c* moves from the third zone 115*c* to the second zone 115*b*, the antenna providing the diversity path will not be suited to providing maximum gain in the second zone 115*b* if it is designed for the 2.4 GHz carrier frequency of the first and third zones 115*a* and 115*c*, respectively. Similarly, if the antenna is designed to operate at 5 GHz, it will not provide maximum gain in the 2.4 GHz zones A and C. In either case, data transfer rates are sacrificed due to the antenna design when not in its "native" zone. Moreover, monopole antennas typically used for antenna diversity start at a disadvantage in that their omnidirectional beam patterns have a fixed gain.

In contrast to simple monopole antennas providing antenna diversity is a directive antenna, sometimes referred to as an antenna array. Such an array can be used to steer an antenna beam to provide maximum antenna gain in a particular direction. As taught in U.S. patent application Ser. No. 09/859,001, filed May 16, 2001, entitled "Adaptive Antenna for Use in Wireless Communication Systems", the entire teachings of which are incorporated herein by reference, one type of antenna array utilizes the property that when a passive quarter wave monopole or half wave dipole antenna element is near its primary resonance, different loading conditions can make the antenna reflective or directive. If both the active and passive elements are made longer, directive gain can be increased.

The present invention advances the concept that if the passive element is made longer, like a half wave monopole or full wave dipole, in the neighborhood of a spatial-harmonic resonance, such as, the second spatial-harmonic resonance, the passive element can be made reflective or directive and operable in multiple frequency bands.

Using the concept of resonating near a spatial-harmonic, a linear, circular or other geometric array using the principles of the present invention may exhibit a 3 dB bandwidth of over 50% compared to a non-resonating directive antenna, and the directive gain roughly doubles. When added to the first resonance (i.e., at the fundamental frequency, such as at 2.4 GHz), the entire band covers well over an octave in two distinct sub-bands.

Thus, continuing to refer to FIG. 1, when the third station 120*c* is transported from the third zone 115*c* to the first zone 115*a* via the second zone 115*b*, it enjoys high antenna gain throughout the move with seamless wireless connection to the distribution system 105 through connections with access points C, B, and A, in that order, even though the third station 120*c* travels from 2.4 GHz 802.11 to 5 GHz 802.11 and back to 2.4 GHz 802.11.

Figure 2A:
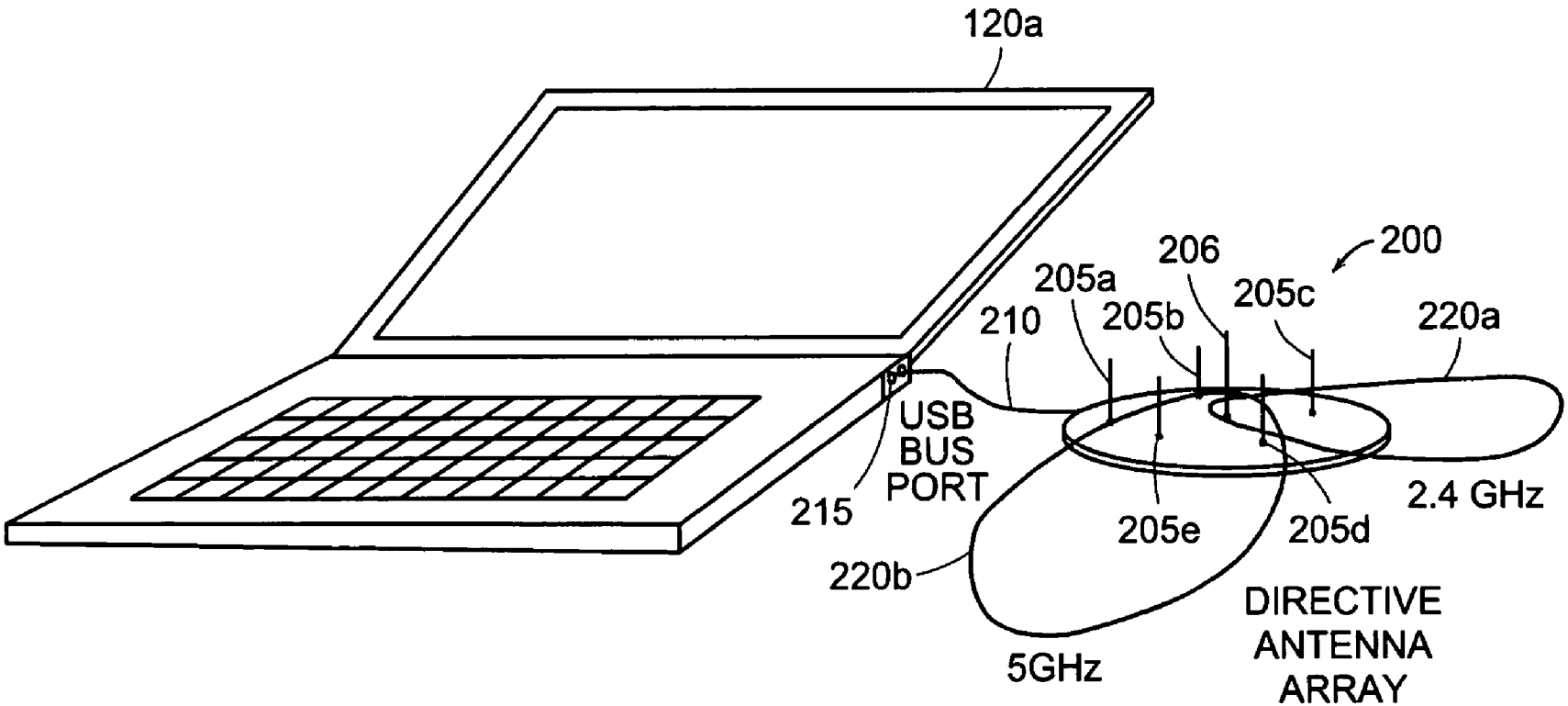
FIG. 2A is a diagram of a wireless station using a monopole embodiment of the directive antenna to operate in the WLAN of FIG. 1.

FIG. 2A is an isometric diagram of the first station 120*a* that uses a directive antenna array 200, configured as a circular array, that is external from the chassis of the first station 120*a*. In an alternative embodiment, the directive antenna array 200 may be disposed on a PCMCIA card located internal to the first station 120*a*. In either embodiment, the directive antenna array 200 may include five monopole passive antenna elements 205*a*, 205*b*, 205*c*, 205*d*, and 205*e* (collectively, passive antenna elements 205) and at least one monopole, active antenna element 206. In an alternative embodiment, the directive antenna array 200 may include as few as one passive antenna element parasitically coupled to at least one active antenna element. The directive antenna array 200 is connected to the station 120*a* via a universal system bus (USB) port 215.

The passive antenna elements 205 in the directive antenna array 200 are parasitically coupled to the active antenna element 206 to allow scanning of the directive antenna array 200. By scanning, it is meant that at least one antenna beam of the directive antenna array 200 can be rotated 360° in increments associated with the number of passive antenna elements 205. An example technique for determining scan angle is to sample a beacon signal, for example, at each scan angle and select the one that provides the highest signal-to-noise ratio. Other measures of performance may also be used, and more sophisticated techniques for determining a best scan angle may also be employed an used in conjunction with the directive antenna array 200.

The directive antenna array 200 may also be used in an omni-directional mode to provide an omni-directional antenna pattern (not shown). The stations 120 may use an omni-directional pattern for Carrier Sense prior to transmission. The stations 120 may also use the selected directional antenna when transmitting to and receiving from the access points 110. In an 'ad hoc' network, the stations 120 may revert to an omni-only antenna configuration, since the stations 120 can communicate with any other station 120.

In addition to the scanning property, the directive antenna array 200 can provide a 2.4 GHz beam 220*a* and a 5 GHz beam 220*b* (collectively, beams 220). The beams 220 may be generated simultaneously or at different times. Generation of the beams is supported by appropriate choices of antenna length and spacing. Other factors may also contribute to the dual beam capability, such as coupling to ground, input impedance, antenna element shape, and so forth. It should be understood that 2.4 GHz and 5 GHz are merely exemplary frequencies and that combinations of integer multiples or non-integer multiples of the fundamental frequency may be supported by appropriate design choices according to the principles of the present invention.

Figure 2B:
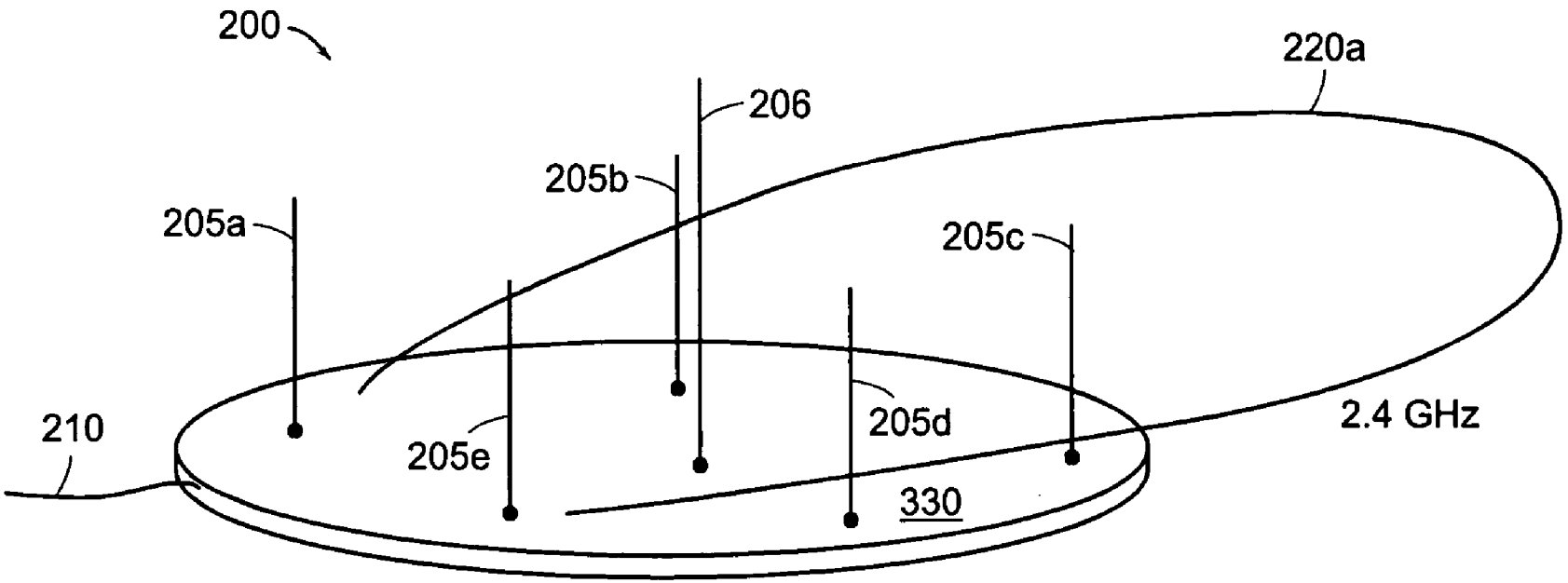
FIG. 2B is an isometric diagram of the directive antenna of FIG. 2A.

FIG. 2B is a detailed view of the directive antenna array 200 that includes the passive antenna elements 205 and active antenna element 206 discussed above. The directive antenna array 200 also includes a ground plane 330 to which the passive antenna elements are electrically coupled, as discussed below in reference to FIG. 2C.

The directive antenna array 200 provides a directive antenna lobe, such as antenna lobe 220*a* for 2.4 GHz 802.11 WLAN, angled away from antenna elements 205*a* and 205*e*. This is an indication that the antenna elements 205*a* and 205*e* are in a "reflective" or "directive" mode and that the antenna elements 205*b*, 205*c*, and 205*d* are in a "transmissive" mode. In other words, the mutual coupling between the active antenna element 206 and the passive antenna elements 205 allows the directive antenna array 200 to scan the directive antenna lobe 220*a*, which, in this case, is directed as shown as a result of the modes in which the passive antenna elements 205 are set. Different mode combinations of passive antenna elements 205 result in different antenna lobe 220*a* patterns and angles.

Figure 2C:
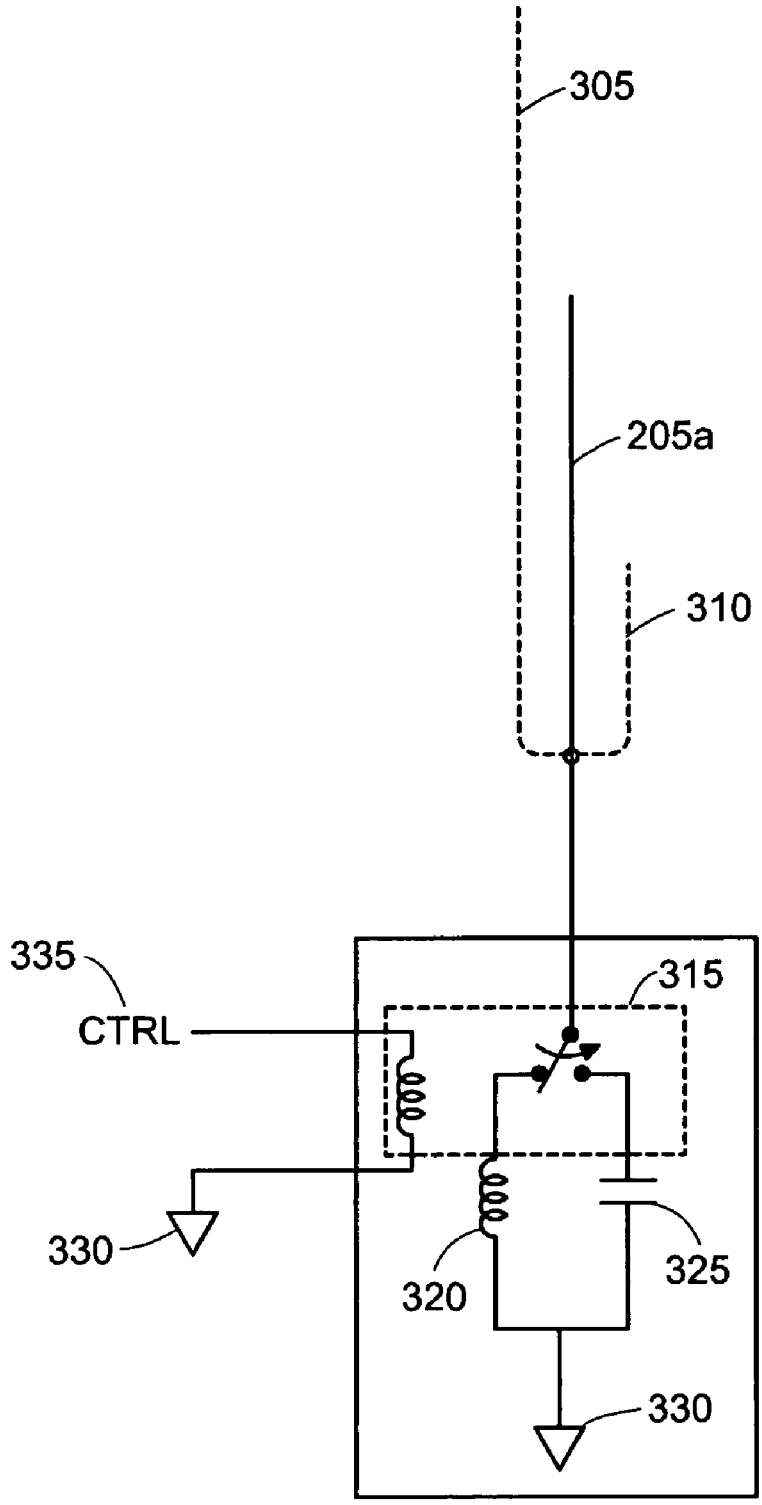
FIG. 2C is a schematic diagram of example reactive loads and switches used to change the phase of the antenna elements of FIG. 2B.

FIG. 2C is a schematic diagram of an example circuit or device that can be used to set the passive antenna elements 205 in the reflective or transmissive modes. The reflective mode is indicated by a representative "elongation" dashed line 305, and the transmissive or directive mode is indicated by a "shortened" dashed line 310. The representative dashed lines 305 and 310 are caused by coupling the passive antenna element 205*a* to the ground plane 330 via an inductive element 320 or capacitive element 325, respectively. The coupling of the passive antenna element 205*a* through the inductive element 320 or capacitive element 325 is done via a switch 315. The switch may be a mechanical or electrical switch capable of coupling the passive antenna element 205*a* to the ground plane 330 in a manner suitable for this RF application. The switch 315 is set via a control signal 335 in a typical switch control manner.

Coupled to the ground plane 330 via the inductor 320, the passive antenna element 205*a* is effectively elongated as shown by the longer representative dashed line 305. This can be viewed as providing a "backboard" for an RF signal coupled to the passive antenna element 205*a* via mutual coupling with the active antenna element 206. In the case of FIG. 2B,.both passive antenna elements 205*a* and 205*e* are connected to the ground plane 330 via respective inductive elements 320. At the same time, in the example of FIG. 2B, the other passive antenna elements 205*b*, 205*c*, and 205*d* are electrically connected to the ground plane 330 via respective capacitive elements 325. The capacitive coupling effectively shortens the passive antenna elements as represented by the shorter representative dashed line 310. Capacitively coupling all of the passive antenna elements 205 effectively makes the directive antenna array 200 into an omni-directional antenna.

It should be understood that alternative coupling techniques may also be used between the passive antenna elements 205 and ground plane 330, such as delay lines and lumped impedances.

Figure 3:
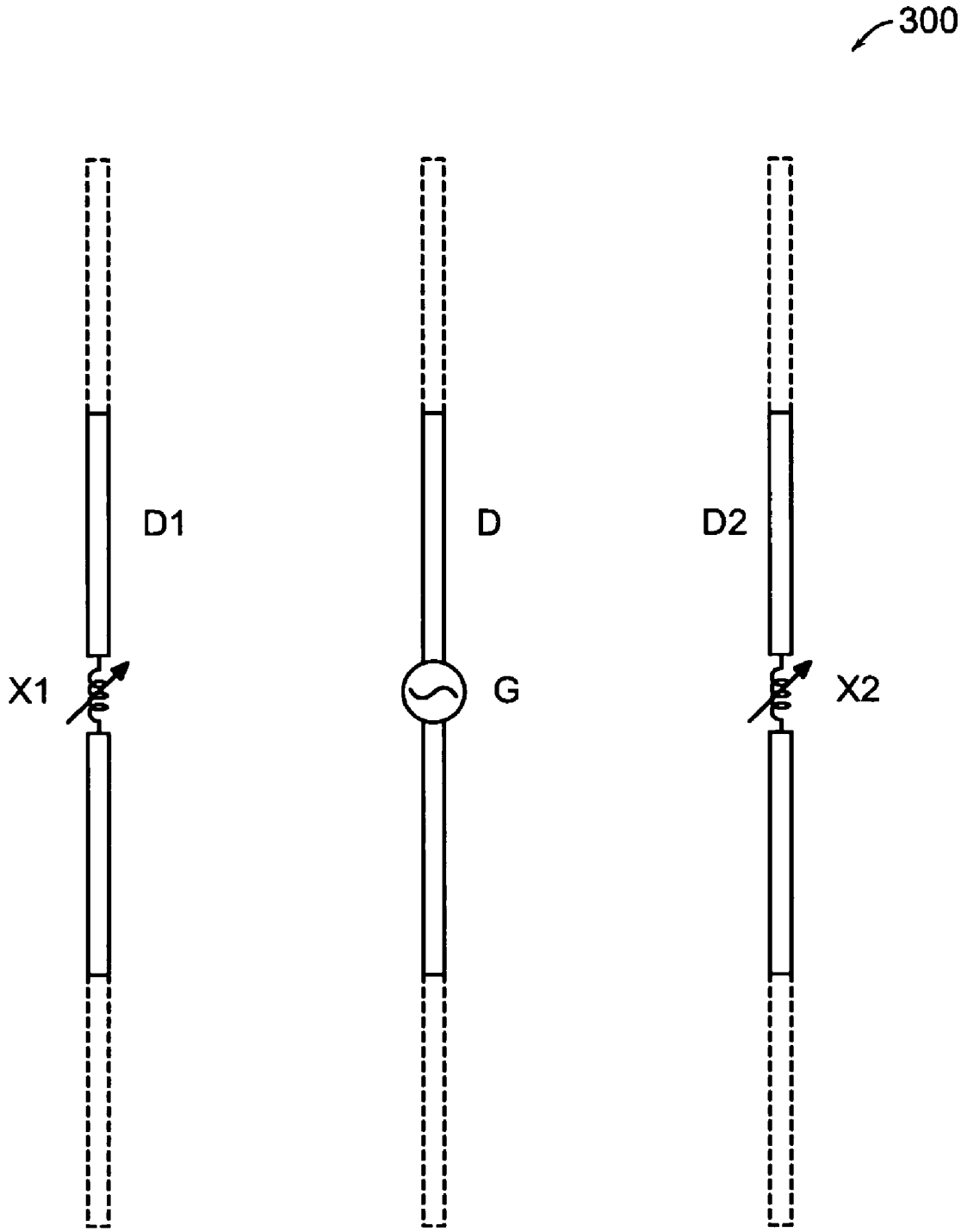
FIG. 3 is diagram illustrating a linear array of three dipoles, forming an alternative embodiment of the directive antenna of FIG. 2A.

FIG. 3 is a schematic diagram of a 3-dipole array 300 used to illustrate the concept of multi-frequency beam scanning. The centered, active, half wave dipole D is shown fed by a generator G. The total physical length of the dipole D is depicted in solid lines. The two dipoles D1 and D2 on either side of the active dipole D1, also shown in solid lines, are loaded with reactors or impedances X1 and X2. The values of the reactors X1 and X2 make one dipole (e.g., D1) reflective and the other dipole (e.g., D2) directive, thereby making the array 300 similar to a classic Yagi array.

When the three antennas D, D1, D2 are lengthened (i.e., the lengths are scaled proportional to frequency), as indicated by dashed lines, they approach a second resonance, where the total electrical length of each antenna is roughly full wave. Dipoles D1 and D2 are again reflective and directive with the same loading X1 and X2. An indication of reaching the second-harmonic resonance is the swapped location between reflector and director, caused by the second harmonic resonance having a different impedance property from the first resonance.

Figure 4A:
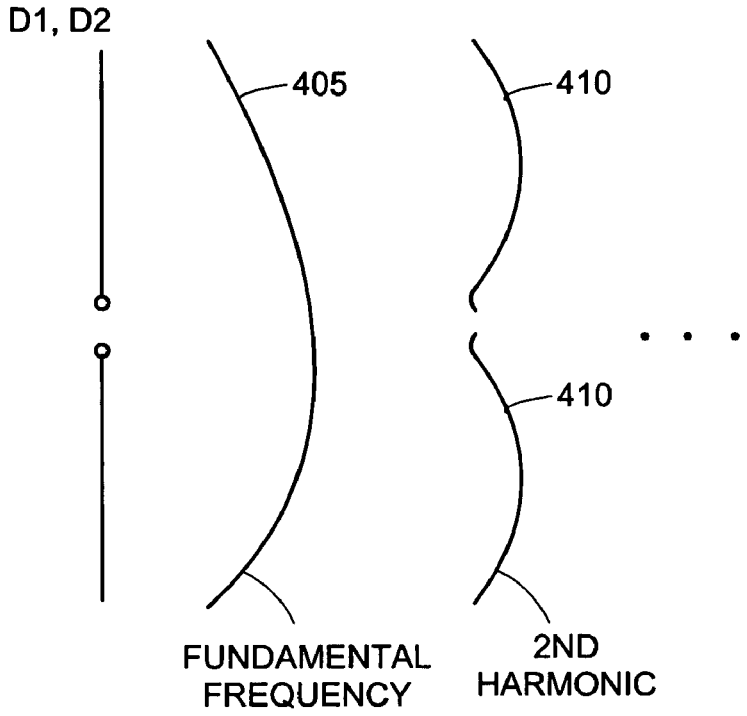
FIG. 4A is a spatial-frequency current-distribution diagram of a dipole antenna used in an alternative embodiment of the directive antenna of FIG. 2A.

FIG. 4A is a schematic diagram of a spatial-harmonic current distribution on the passive antenna elements D1, D2. The fundamental frequency spatial-harmonic current distribution 405 has a single peak along the antenna elements. The second spatial-harmonic current distribution 410 has two peaks along the antenna element. The third harmonic spatial current distribution (not shown) has three peaks, and so forth.

Figure 4B:
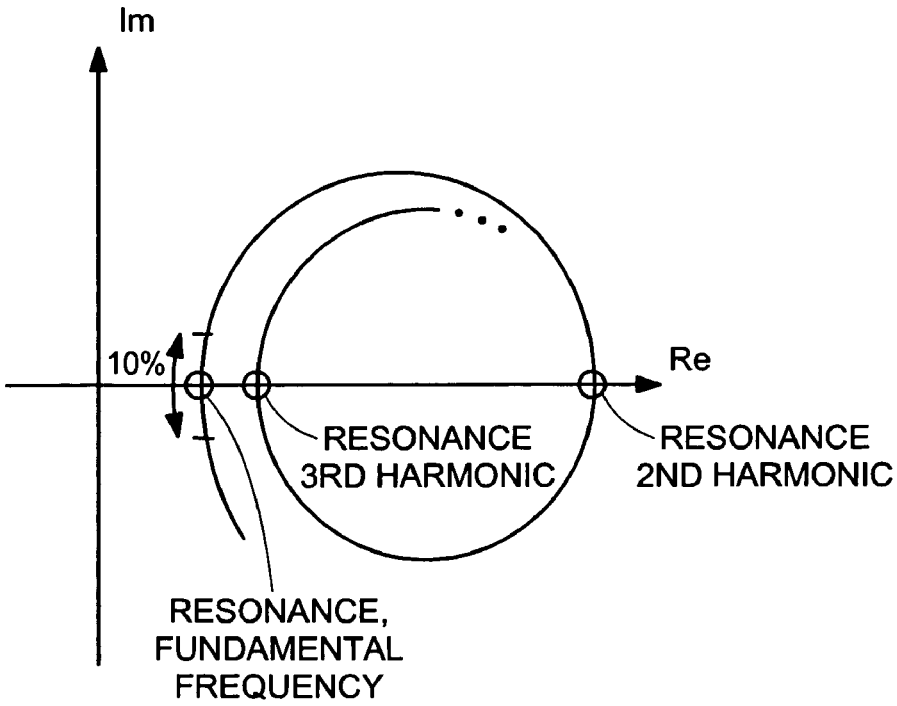
FIG. 4B is a plot of frequencies illustrating points of resonance of the antenna element of FIG. 4A.

FIG. 4B is a plot of the reaction of a passive antenna element D1, D2 caused by parasitic coupling with the active antenna element 206 transmitting a range of carrier frequencies. At each crossing of the real axis, the passive antenna resonates. The range within which the passive antenna element will resonate in a manner producing a substantive effect toward generating a composite beam (e.g., beams 220*a*, 220*b*, FIG. 2) is ±5% of the real-axis crossing.

Figure 5:
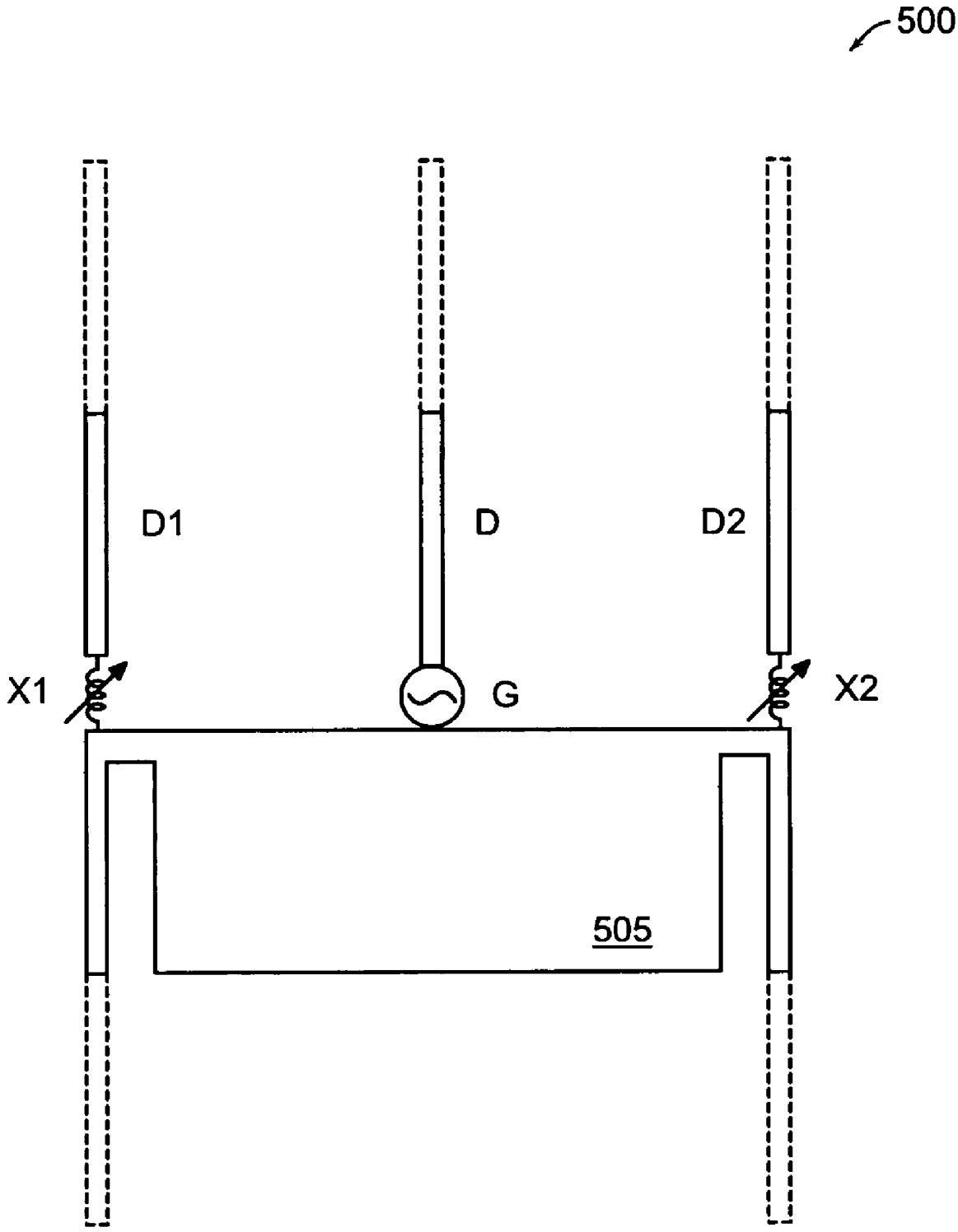
FIG. 5 is a variation of the directive antenna of FIG. 3 linking the lower halves of the dipoles to a common ground.

FIG. 5 is a schematic diagram of an alternative monopole array 500 employing the principles of the present invention. The monopole array 500 includes an active antenna D and passive antenna elements D1 and D2. A ground plane 505 is vertical and shaped to create a balanced resonant structure imaging the passive monopole antenna elements D1, D2. The passive antenna elements D1 and D2 are parasitically coupled to the active antenna element D and electrically coupled to the ground plane 505 via impedance elements X1 and X2, respectively. Electrically coupling the passive antenna elements D1, D2 to ground 505 may be done via selecting a state of respective switches (not shown). Further, the impedances X1 and X2 may be electrically adjustable.

In operation, the monopole array 500 directs an antenna beam by re-radiating a carrier signal (e.g., 2.4 GHz or 5 GHz), transmitted by the active antenna element D, to form a composite beam (beam 220*a* and 220*b*). The re-radiation may be viewed as progressive, caused by a pattern of resonating passive and active antenna elements, as indicated in FIG. 6.

Figure 6:
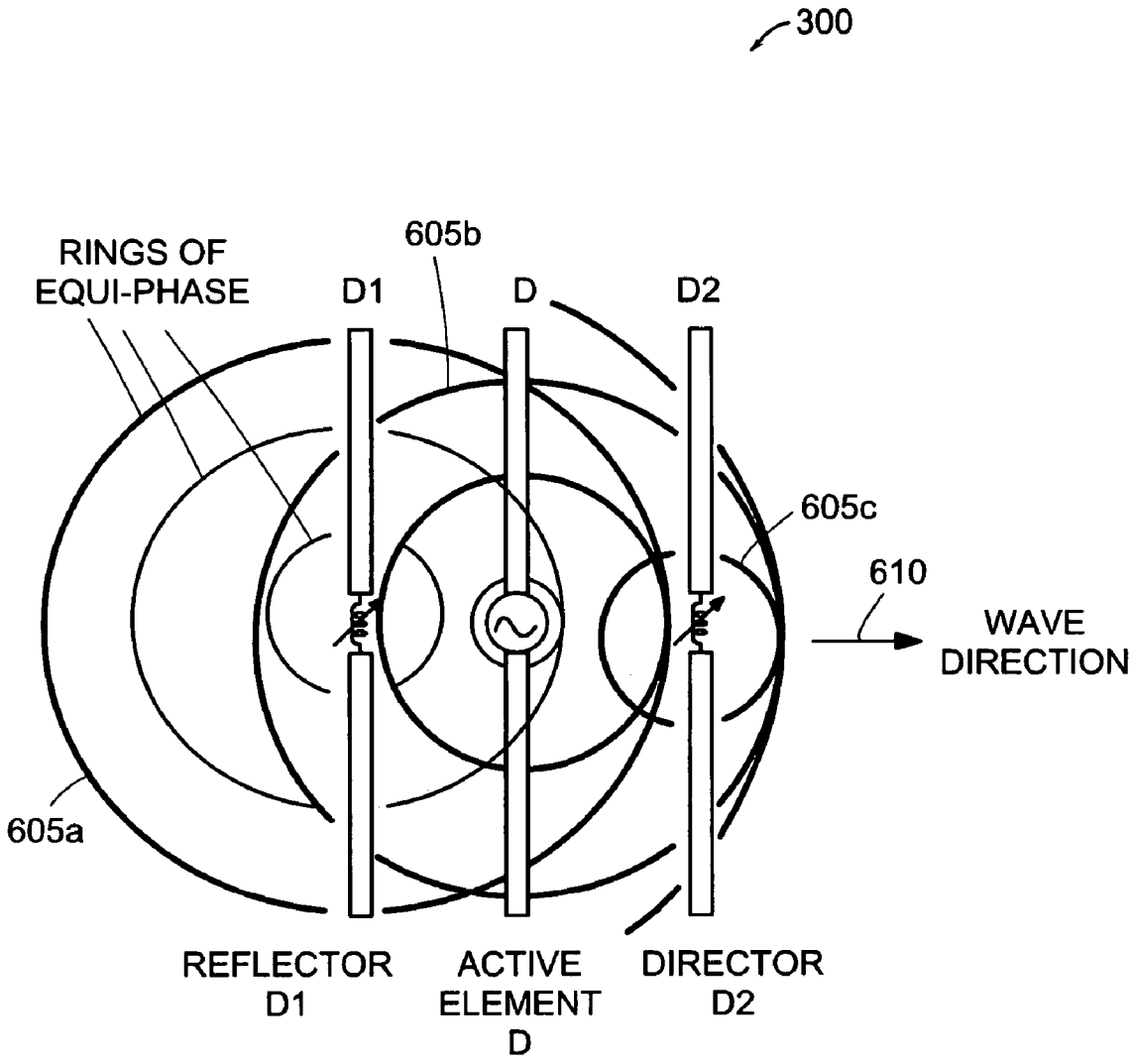
FIG. 6 is a diagram of the dipole embodiment of the directive antenna of FIG. 3 and re-radiation therefrom.

Referring to FIG. 6, the directive antenna 200 has a progressive phase moving from left to right. The progressive phase resonating process occurs as follows: the active antenna D resonates at the carrier frequency (e.g., fundamental or second harmonic frequency), the reflective passive antenna element D1 resonates at the same frequency, the active antenna element D continues resonating as the electromagnetic wave resulting from the reflective passive antenna element D1 passes, then the directive passive antenna D2 resonates. RF waves 605*a*, 605*b*, and 605*c* occur in that order, and a resulting composite beam (e.g., FIG. 2, beam 220*a*) is directed in the direction of the arrow 610. There is generally a benefit to making the active antenna element D shorter than the passive antenna elements D1 and D2 so that it causes less interference with the re-radiating beam(s).

Figure 7:
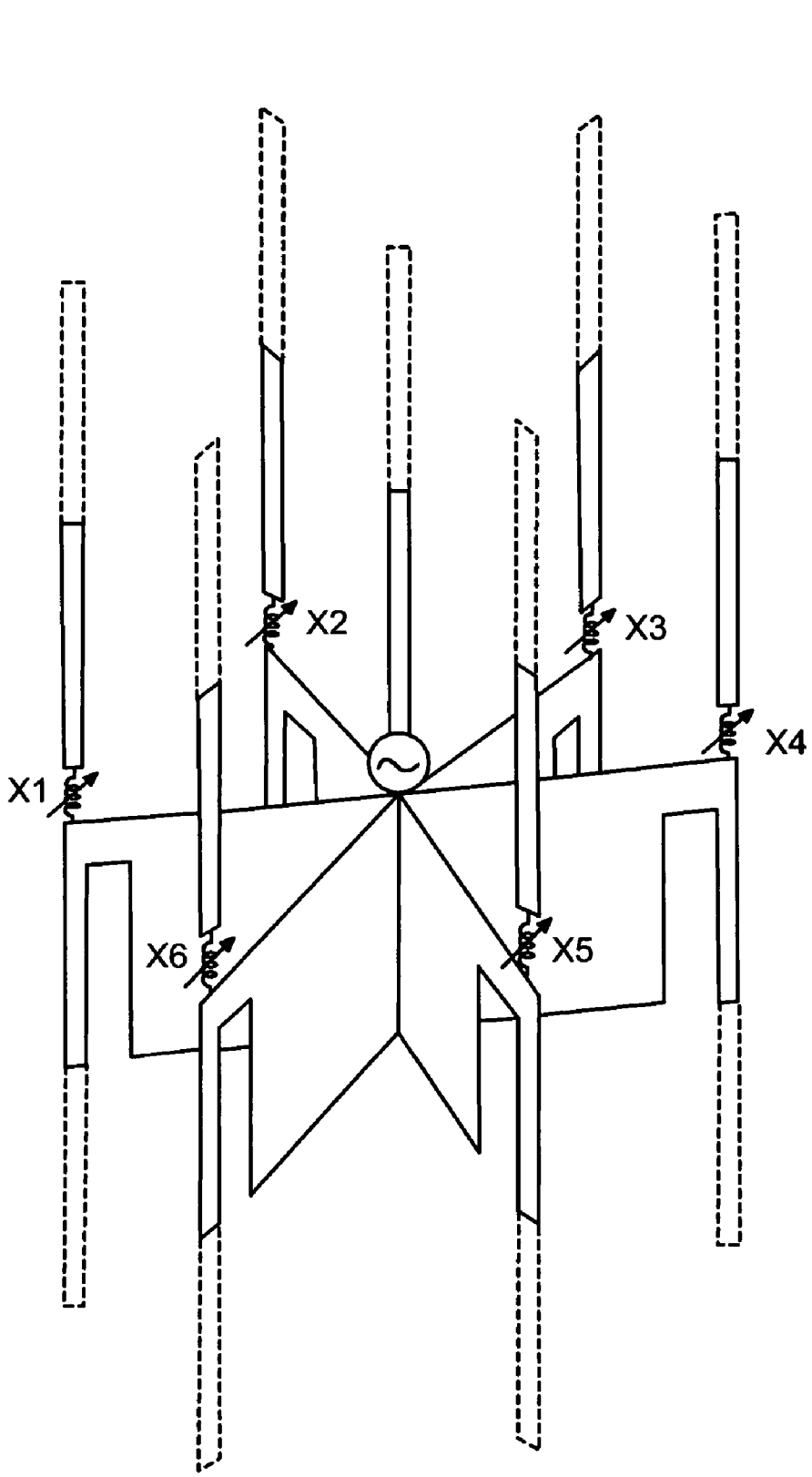
FIG. 7 is an isometric diagram of a ring array embodiment of the directive antenna of FIG. 5.

FIG. 7 is an example of the monopole array 500 of FIG. 5 arranged in a ring array. A composite beam formed (discussed in reference to FIGS. 8A, 8B, 9A, and 9B) can scan in azimuth by rotating the values assigned to the impedance elements X1–X6.

The results of a simulation of an example of this monopole ring array 700 follows. The example monopole ring array 700 has an overall dimension of 1.3" diameter×1.72" tall. Half of the consecutive passive elements are loaded with 3 ohms (typical short circuit resistance of a short-circuited switch), and the remaining three are loaded with 3+j600 ohms.

Figure 8A:
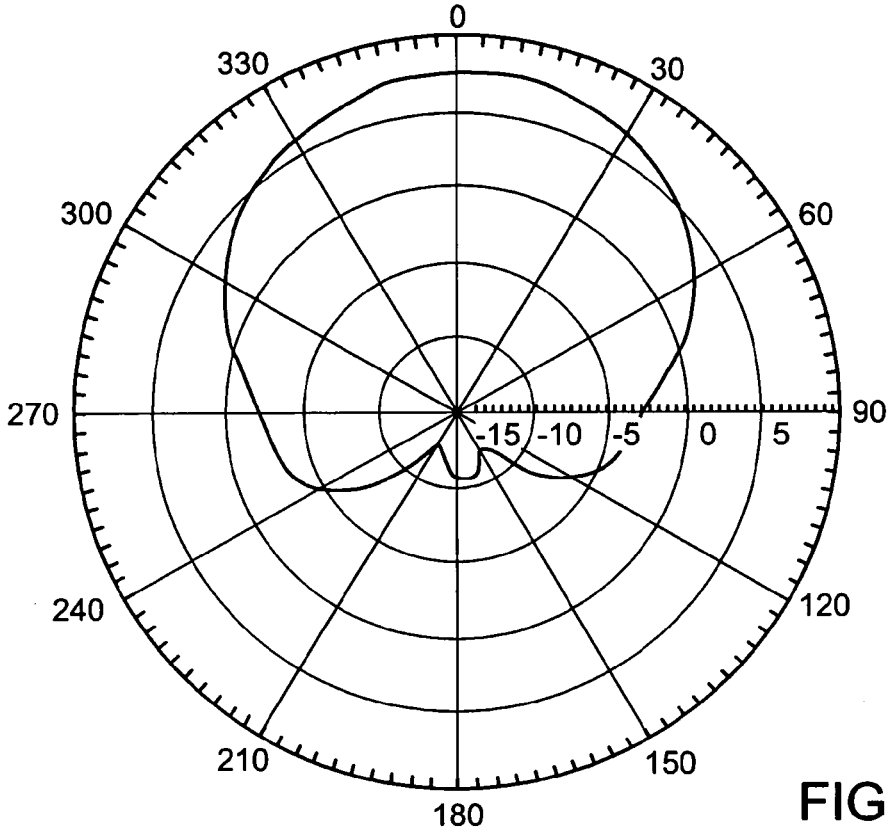
FIGS. 8A and 8B are a set of radiation patterns at 5 GHz for the directive antenna of FIG. 7.
Figure 8B:
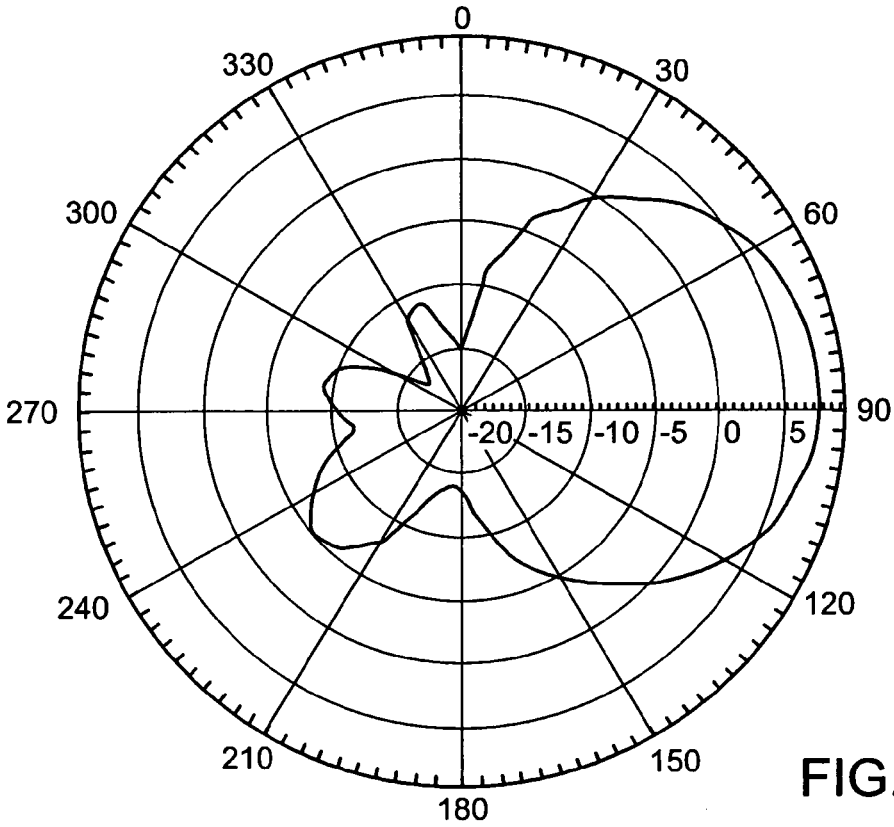

The principal plane patterns at 5 GHz that resulted from the simulation are plotted in FIGS. 8A and 8B. The elevation "cut" is on the right (FIG. 8A), and the azimuth "cut" is on the left (FIG. 8B). As shown by the simulation, these cuts keep the same general shape all through the range of 3.4 GHz to 5.7 GHz. That band of coverage is 50%, which is considered very large for a phased dipole array. The directivity within that band is from 7+dBi to 9+dBi, which is also very attractive.

Figure 9A:
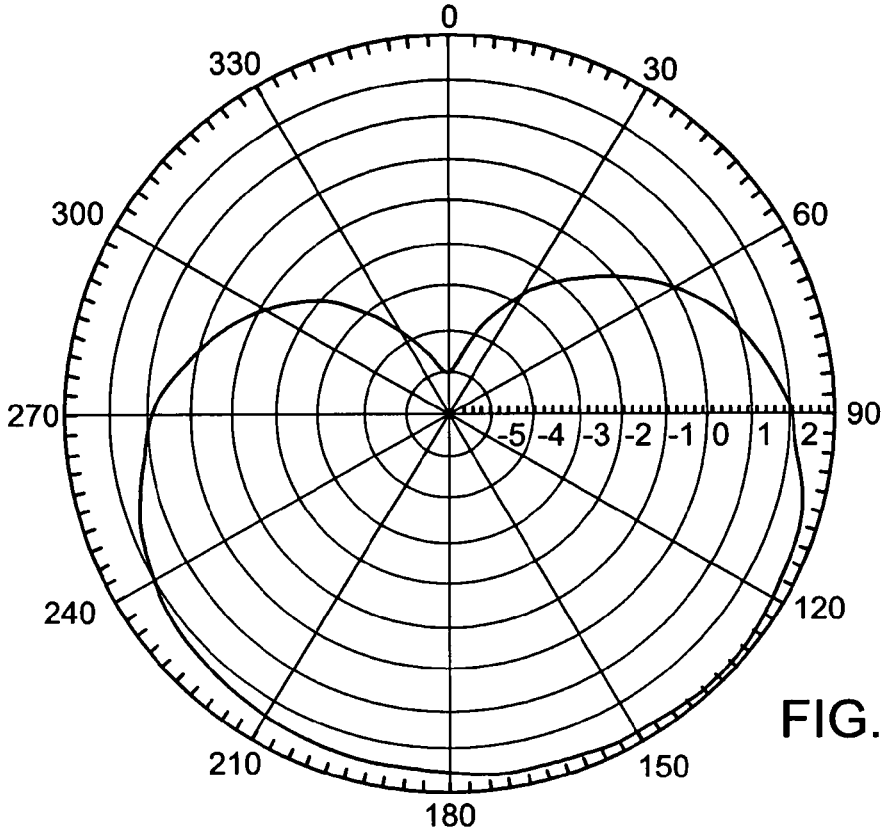
FIGS. 9A and 9B are a set of radiation patterns at 2 GHz for the directive antenna of FIG. 7.
Figure 9B:
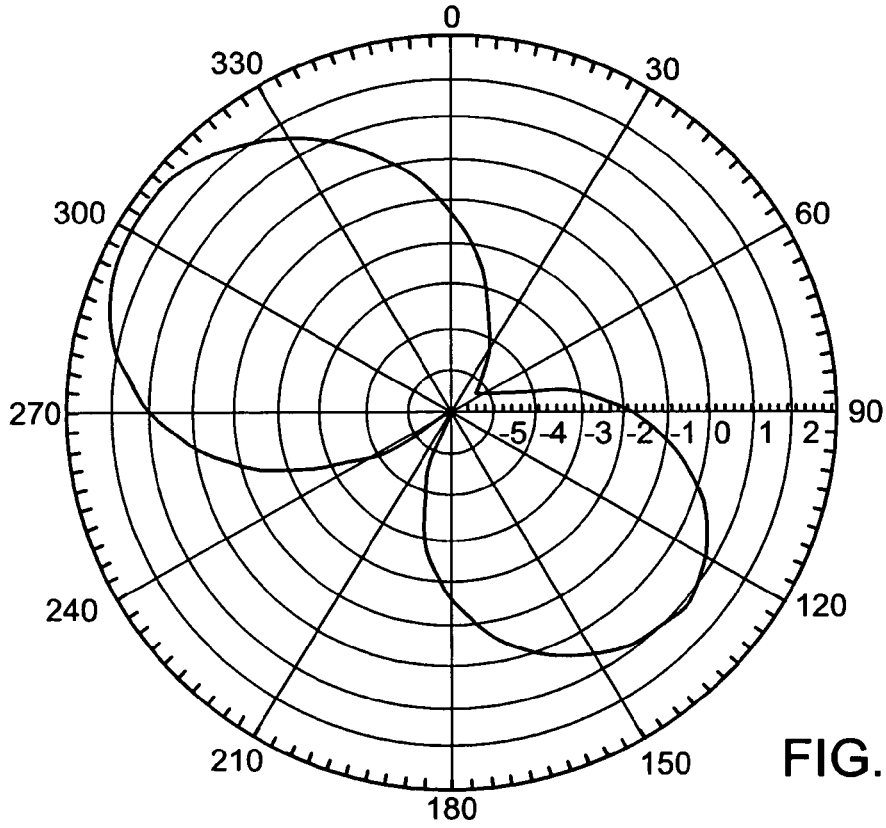

The simulated radiation patterns at 2 GHz are shown in FIGS. 9A and 9B. The elevation pattern as a function of theta is on the right (FIG. 9B), and the conical cut through the beam at theta=60 degs is on the left (FIG. 9A). The directivity is about 3 dBi. The distinct difference between the azimuthal patterns at the two frequencies is in the beam direction, where the 2 GHz beam points south, and the 5 GHz beam points north. This points out the existence of two different modes. In the 5 GHz band, the array is electrically larger than at 2 GHz, so the upper bound of the array gain can be much higher. The simulated gain difference is 5.5 dB for this particular case. The 3-dB bandwidth in the 5 GHz band is wide, over 50%. That is because there are two different gain optimizations at work. One is the element resonant peak, and the other is the arraying peak. The two peaks can be staggered in frequency and broadened in bandwidth.

Figure 10:
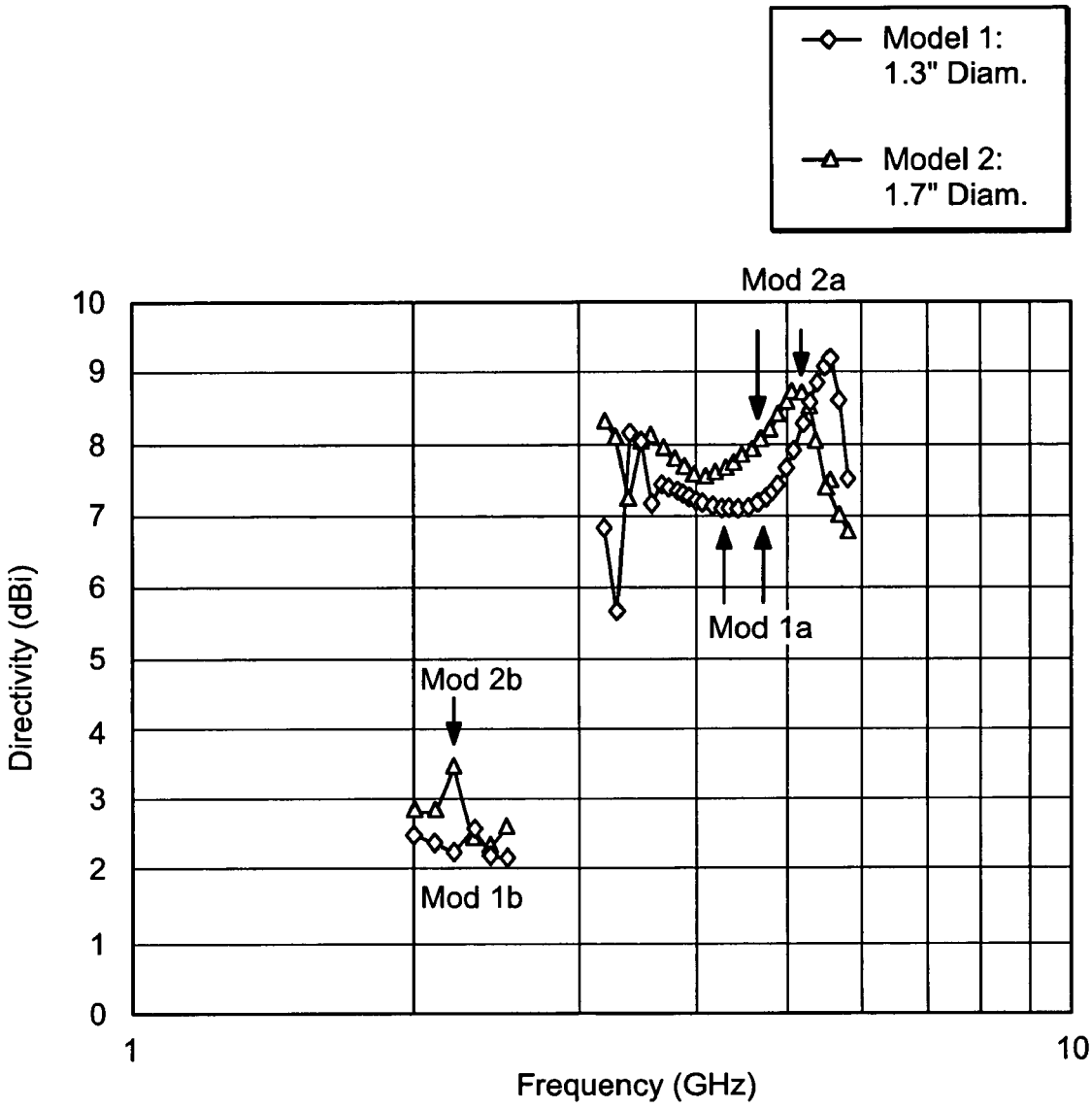
FIG. 10 is a gain plot illustrating directivity of the directive antennas of FIG. 7.

FIG. 10 is a plot of the antenna gain in log scale, so that the performance can be scaled up in frequency easily. The directivity plot is shown for two simulated models: 1.3" diam. and 1.7" diam., respectively, of the circular ring array 700. When the first model is scaled to IEEE 801.11b and 802.11a WLAN frequencies, the directivities are 2.9 and 7.1 dBi, respectively. The second model has better performance. When scaled, the directivities are 3.5 and 8.2–8.7 dBi, respectively. With this arrangement, all 802.11 bands can be covered in one array. In alternative arrangements, bands for other wireless networks can be covered, where the carrier frequencies are substantially harmonics of each other or where the carrier frequencies are not integer multiple harmonics, but the directive antenna array has been designed to support the non-integer multiple harmonic resonances.

The input impedance of the active element can be matched by using a folded monopole technique. Using the folded monopole technique, a folded arm (not shown) is added in parallel to the monopole antenna element and shunted to ground. The folded arm acts as a multiplying factor for the input impedance. The thickness of the folded arm further modifies the multiplying factor. Further, matching can be achieved by adding reactive components, which may be necessary to compensate for an unavoidable variation over the substantial bandwidth the array covers. Transmission line segments can also be used to perform impedance matching. It has the advantage of utilizing a circuit board already in place to create the lines. A combination of any two or all three techniques can be used and may even be needed in order to optimize matching over a broad band. The ground plane does not have to be vertical. It can be partially horizontal or completely horizontal.

A system employing the inventive directive antenna may realize dual band operation using electronically scanned passive arrays, such as the ring array discussed above. The two (or more) bands can be separated more than an octave apart. The technique can also be employed where a wide-band scanning array is required. The wide-band application provides twice the gain of a comparable first resonant array using the prior art. Thus, dual band and wide upper band can be supported with the same type of antennas and electronic parts as in a prior art first resonant array, so there is no increase in cost.

While this invention has been particularly shown and described with references to preferred embodiments thereof, it will be understood by those skilled in the art that various changes in form and details may be made therein without departing from the scope of the invention encompassed by the appended claims.

As examples, the elements do not have to be monopoles or dipoles. They can be other types that support resonance beyond the primary resonance. The spacing of the array elements is likewise not limited to just the second harmonic; they can be a third harmonic or higher.

The actual antenna element resonance may not be integer multiples of the fundamental frequency, supported through the use of 2- or 3-dimensional shapes. This characteristic can be exploited by selecting the element type and adjusting the element shape to resonate in the desired frequency bands of required band separation. For similar reason, the harmonic spacing of the array elements do not necessarily follow an integer multiple series. That is because in the case where the array is a 2-dimensional circular structure, the array has its own series of characteristic resonances. The optimization of the arraying is to have it form a progressive phase from element to element so that the wave can propagate substantially in one direction to form a directive beam. This characteristic of harmonic spacing also lends flexibility in optimizing the frequency bands.

It should be understood that the inventive directive antenna may be employed by various wireless electronic devices, such as handsets, access points, and repeaters, and may be employed in networks, such as cellular systems, wireless Internets, wireless local area networks, and 802.11 networks.

What is claimed is:

1. A directive antenna operable in multiple frequency bands, comprising:

an active antenna element;

at least one passive antenna element parasitically coupled to the active antenna element and having length and spacing substantially optimized to selectively operate at (i) a fundamental frequency associated with the active antenna element or (ii) a higher resonant frequency related to the fundamental frequency; and at least one selectable impedance operatively coupled to said at least one passive antenna element to enable steering of at least one antenna beam formed by applying a signal at the fundamental or higher resonant frequency to the active antenna element to operate in the multiple frequency bands.

2. The directive antenna according to claim 1 wherein the higher resonant frequency is the second harmonic of the fundamental frequency.

3. The directive antenna according to claim 1 wherein the directive antenna is adapted to simultaneously steer antenna beams at the fundamental frequency and the higher resonant frequency.

4. The directive antenna according to claim 1 further including a reactive load coupled between said at least one passive antenna element and a ground.

5. The directive antenna according to claim 4 wherein the reactive load makes the at least one passive antenna element (i) a reflector at the fundamental frequency and the same reactive load turns the at least one passive antenna element into a director at the higher resonant frequency or (ii) a director at the fundamental frequency and the same reactive load turns the at least one passive antenna element into a reflector at the higher resonant frequency.

6. The directive antenna according to claim 1 wherein the antenna elements are monopoles or dipoles.

7. The directive antenna according to claim 1 wherein the antenna elements support more than two resonances.

8. The directive antenna according to claim 1 wherein the length and spacing support more than two frequency bands.

9. The directive antenna according to claim 1 wherein the antenna elements support higher resonant frequencies that are not integer multiples of the fundamental frequency.

10. The directive antenna according to claim 1 wherein the antenna elements are arranged in a manner that the higher resonant frequency is a non-integer multiple of the fundamental frequency.

11. The directive antenna according to claim 1 further including an input impedance coupled to the array across the desired bands to optimize resonance in the desired bands, the input impedance including at least one of the following: a folding arm, lumped impedance element, inductive element, capacitive element, or transmission line segment.

12. The directive antenna according to claim 1 used in cellular systems, handsets, wireless Internets, wireless local area networks (WLAN), access points, remote adapters, stations, repeaters, and 802.11 networks.

13. A method for manufacturing a directional antenna, the method comprising:

assembling an antenna assemblage having at least one active antenna element and at least one passive antenna element electromagnetically coupled to said at least one active antenna element; and electrically coupling at least one selectable impedance component to said at least one passive antenna element in the antenna assemblage, the at least one selectable impedance component affecting a phase of respective, re-radiated, RF signals by the at least one passive antenna element to form at least one composite beam at a first or second frequency band of operation caused by corresponding spatial-harmonic current-distributions on said at least one passive element.

14. The method according to claim 13 wherein the second frequency band of operation is the second harmonic frequency of the first frequency band of operation.

15. The method according to claim 13 wherein the at least one impedance component enables simultaneous steering of a composite beam corresponding to the first frequency band of operation and a composite beam corresponding to the second frequency band of operation.

16. The method according to claim 13 further including electrically coupling switches to the impedance components for selecting an impedance state of the selectable impedance components.

17. The method according to claim 16 wherein selecting the impedance state makes associated passive antenna elements (i) reflective at the first frequency band of operation and the same impedance state makes the associated passive antenna element directive at the second frequency band of operation or (ii) directive at the first frequency band of operation and the same impedance state makes the associated passive antenna element reflective at the second frequency band of operation.

18. The method according to claim 13 where the antenna elements are monopoles or dipoles.

19. The method according to claim 13 wherein, in operation, impedance states of the at least one selectable impedance components affects the phase of more than two resonances.

20. The method according to claim 13 wherein assembling the antenna assemblage includes positioning the antenna elements with the length and spacing between the antenna elements to support more than two frequency bands of operation.

21. The method according to claim 13 wherein the second frequency band of operation is a non-integer multiple of the first frequency band of operation.

22. The method according to claim 13 wherein assembling the antenna assemblage includes arranging the antenna elements in a manner that the second spatial-harmonic current-distributions of the passive elements are a non-integer multiple of the first frequency band of operation.

23. The method according to claim 13 further including electrically coupling a fixed or adjustable input impedance to the at least one active antenna element of the antenna assemblage.

24. The method according to claim 13 further including electrically coupling an interface to the antenna assemblage for use in cellular systems, handsets, wireless Internets, wireless local area networks (WLAN), access points, remote adapters, stations, repeaters, and 802.11 networks.

25. A directive antenna operable in multiple frequency bands, comprising:

at least one active antenna element;

at least one passive antenna element electromagnetically coupled to said at least one active antenna element and having length and spacing substantially optimized to selectively operate at (i) a fundamental frequency band of operation associated with the active antenna element or (ii) a higher resonant frequency band of operation related to the fundamental frequency band of operation; and means for affecting the phase of respective, re-radiated signals by the passive antenna elements to form a composite beam at the fundamental frequency band of operation or the higher resonant frequency band of operation caused by corresponding spatial-harmonic current-distributions on the passive elements.

* * * * *